US009745670B2

(12) United States Patent
Pham et al.

(10) Patent No.: US 9,745,670 B2
(45) Date of Patent: Aug. 29, 2017

(54) PATTERNED SLIT FIXTURES AND SURFACES FOR HIGH THROUGHPUT SLIT-SURFACE ELECTROSPINNING

(71) Applicants: Quynh Pham, Methuen, MA (US); Upma Sharma, Somerville, MA (US); Xuri Yan, Boston, MA (US); John Marini, Weymouth, MA (US)

(72) Inventors: Quynh Pham, Methuen, MA (US); Upma Sharma, Somerville, MA (US); Xuri Yan, Boston, MA (US); John Marini, Weymouth, MA (US)

(73) Assignee: Arsenal Medical, Inc., Watertown, MA (US)

( * ) Notice: Subject to any disclaimer, the term of this patent is extended or adjusted under 35 U.S.C. 154(b) by 177 days.

(21) Appl. No.: 14/449,779

(22) Filed: Aug. 1, 2014

(65) Prior Publication Data

US 2015/0035181 A1 Feb. 5, 2015

Related U.S. Application Data

(60) Provisional application No. 61/861,624, filed on Aug. 2, 2013.

(51) Int. Cl.
*D01D 5/00* (2006.01)
*D01D 5/34* (2006.01)

(52) U.S. Cl.
CPC ..... *D01D 5/0069* (2013.01); *D01D 5/0061* (2013.01); *D01D 5/34* (2013.01)

(58) Field of Classification Search
None
See application file for complete search history.

(56) References Cited

U.S. PATENT DOCUMENTS

2002/0175449 A1* 11/2002 Chu ..... D04H 1/728 264/465
2005/0276841 A1 12/2005 Davis et al.
2007/0232169 A1 10/2007 Strickler et al.
2009/0196905 A1 8/2009 Spada et al.
2012/0193836 A1* 8/2012 Sharma ..... D01D 5/34 264/465

FOREIGN PATENT DOCUMENTS

WO WO9853768 A1 12/1998
WO WO0132229 A1 5/2001

* cited by examiner

*Primary Examiner* — Mary F Theisen

(57) ABSTRACT

The present invention relates generally to the field of electrospinning. In particular, the present invention relates to an electrospinning device that includes a slit-fixture defined by an elongate aperture disposed between opposing elements of an electrically conductive material. These elements include a variety of patterns/shapes that affect the flow of fluid through the aperture and the electrical field across the aperture.

16 Claims, 31 Drawing Sheets

PATTERNED SLIT FIXTURES AND SURFACES FOR HIGH THROUGHPUT SLIT-SURFACE ELECTROSPINNING

CROSS REFERENCE TO RELATED APPLICATIONS

This application claims priority to and the benefit of U.S. Provisional Application Ser. No. 61/861,624, filed on Aug. 2, 2013, Titled (Patterned Slit Fixtures for High Throughput Split-Surface Electrospinning), herein incorporated by reference in its entirety.

FIELD OF THE INVENTION

The present invention relates generally to the field of electrospinning. In particular, the invention relates to an electrospinning device that includes a fixture with an elongate aperture disposed between opposing elements of an electrically conductive material. These elements may include a variety of patterns and/or shapes that affect fluid flow through the aperture and electrical field across the aperture.

BACKGROUND OF THE INVENTION

Electrospinning is a versatile technique for the production of small-diameter fibers of many natural and synthetic polymers. This includes biopolymers (DNA, gelatin), liquid crystalline polymers (polyaramid), textile fiber polymers (nylon) and electrically conducting polymers (polyaniline) etc. (*J. of Macromolecular Science,* 36(2): 169 (1997); *J. of Biomedical Materials Research* 72(1): 156 (20505); *Nanotechnology* 7(3): 216 (1996); *Polymer* 43(3): 775 (2002); *Applied Physics Letters* 83(20): 4244 (2003)). Electrospinning is a process in which ions are transferred to the gas phase by the application of a high electrical charge to a polymer solution in a liquid reservoir. Exposure of a small volume of electrically conductive liquid to an electric field causes the liquid to deform from the shape established by surface tension alone. As the voltage increases the force of the electric field approaches the surface tension of the liquid, resulting in the formation of a Taylor cone with convex sides and a rounded tip. When a threshold voltage is reached the slightly rounded tip of the cone inverts and emits a jet of liquid called a cone-jet or sheath-jet.

As the highly charged liquid jet stream travels in the air towards an electrically grounded collector it experiences bending and stretching effects due to charge repulsion and, in the process, becomes increasingly thinner. As the volatile solvent evaporates very fine polymer fibers, typically on the micro- or nano-scale, are collected on the grounded collector.

Current needle electrospinning techniques typically operate at flow rates between 1-10 mL/h, resulting in low throughput and deposition (i.e., polymer solidification). While slit-surface electrospinning offers a way to increase this output rate, this method tends to be unstable over longer periods of time and demonstrates meniscus growth. Thus, there is a need for a stable, high throughput slit-surface electrospinning process that provides longer run times and reduces meniscus formation.

SUMMARY OF THE INVENTION

In one aspect, the present invention relates to a slit-surface formed by two walls that have an S-wave pattern with matching wavelengths and amplitudes. In one embodiment, the inner and outer walls have an S-wave pattern that mirror each other. In one embodiment, the inner and outer walls have an S-wave pattern that mirror each other, and where the distance between the surfaces of the inner and outer walls is constant throughout their length.

In another aspect, the present invention relates to a slit-surface in which some, but not all, of the walls have an S-wave pattern. In one embodiment, the inner walls have an S-wave pattern while the outer walls are substantially straight. In another embodiment, outer walls have an S-wave pattern while the inner walls are substantially straight.

In another aspect, the present invention relates to a slit-surface in which the inner and outer walls have an S-wave or sinusoidal shape that are not mirror images of each other. In one embodiment, the pattern includes outer walls with an S-wave pattern having a higher frequency than the S-wave pattern of the inner walls. In one embodiment, the pattern includes inner walls with an S-wave pattern having a higher frequency that the S-wave pattern of the outer walls. In one embodiment, the inner and outer walls have and S-wave pattern that are aligned such that their wavelengths and amplitudes are matching.

In another aspect, the present invention relates to slit-surface patterns with non-curvy (i.e., non-sinusoidal) patterns. In one embodiment such patterns include, but are not limited to, hexagonal patterns, diamond patterns and the like.

In another aspect, the present invention relates to a slit-surface in which the pattern is applied to the top surface of the slit-fixture, while the inner and outer walls are substantially straight. In one embodiment, the pattern applied to the top surface is an S-wave pattern. In one embodiment, the top surface has an outwardly sloping apex. In one embodiment, the top surface has an inwardly sloping apex. In one embodiment, the top surface is concave. In one embodiment, the top surface is convex. In one embodiment, the top surface is patterned with protrusions or indentations that serve as auxiliary electrodes or enhances electric field strength.

In one aspect, the slit-surface pattern is not limited to linear shapes, but can include a closed loop such as a circle, square, triangle or the like.

In one aspect, the present invention relates to an electrospinning apparatus in which one slit-fixture (i.e., core-slit) is positioned within another slit-fixture (i.e., sheath-slit). It will be appreciated that any combination of the shapes/patterns described herein may be used for either (or both) of these fixtures.

In one aspect, the electrospinning devices for use with two or more different polymers that do not require the presence of a core-slit to generate core-sheath electrospun fibers. In one embodiment, feed tubes/needles deliver the core polymer solution directly into the emitted sheath jet. In one embodiment, feed lines/tubes deliver core polymer solution directly into the emitted sheath jet from a location underneath the sheath jet. In one embodiment, a patterned array of slit-surfaces individually feed the core polymer solution directly into each emitted sheath jet.

In one aspect, a variety of design features are available for diverting air flow away from the slit-surface, including for example the introduction of protrusions (i.e., wings) and increasing the thickness of the apex.

In one aspect, the present invention relates to a fixture (i.e., wiper) for removal of excess polymer solution that accumulates at the slit-surface due to meniscus growth and/or polymer solidification.

BRIEF DESCRIPTION OF THE DRAWINGS

Non-limiting embodiments of the present invention will be described by way of example, with reference to the accompanying figures, which are schematic in nature and are not intended to be drawn to scale. In the figures, each identical or nearly identical component illustrated in typically represent by a single numeral. For purposes of clarity, not every component is labeled in every figure, nor is every component of each embodiment of the invention shown where illustration is not necessary to allow those of ordinary skill in the art to understand the invention. In the figures.

DETAILED DESCRIPTION OF THE PREFERRED EMBODIMENTS

The present invention relates generally to the field of electrospinning. In particular, the invention relates to an electrospinning device that includes an electrically conductive vessel disposed between opposing elements having a variety of patterns and/or shapes that control the flow of fluids through the aperture and electrical field across the aperture.

While various aspects and embodiments of the present invention are described below, it should be understood that they are presented by way of illustration rather than limitation. The breadth and scope of the present invention is intended to cover all modifications and variations that come within the scope of the following claims are their equivalents.

The invention described herein discloses different types of patterned slit-fixtures to control the spatial and temporal emergence of electrospinning jets along a slit-surface. As used herein, the term "slit-fixture" refers to a fixture positioned on an electrospinning device through which polymer fluid exits, resulting in fiber(s). As used herein, the term "slit-surface" refers to the aperture (i.e., opening(s) or hole(s)) within a slit fixture through which the polymer fluid exits. Embodiments of the invention disclosed herein disclose a number of different designs that can be used for slit-surface electrospinning. Without being limiting to specific design features and/or methods of function, the embodiments described herein relate generally to the use of patterned fixtures to create slit-surfaces that establish (1) flow patterns or gradients and/or (2) non-uniform electric fields.

A major benefit of the patterned fixtures of the present invention is that they control the spatial and temporal emergence of electrospinning jets along the aperture surface. This provides at least two notable effects on the electrospinning process itself. First, the electrospinning jets are locally constrained, exhibiting little to no lateral movement as typically observed when using uniform straight slit-surfaces. Second, very little meniscus growth of the solution occurs along/within the aperture itself. The ability to direct (e.g., control) fluid flow while minimizing aperture occlusion due to polymer solidification (i.e., meniscus growth) provides enhanced electrospinning stability, allowing for longer continuous run times. As a result, the efficiency and productivity of slit-surface electrospinning is significantly increased.

Figure 1A:
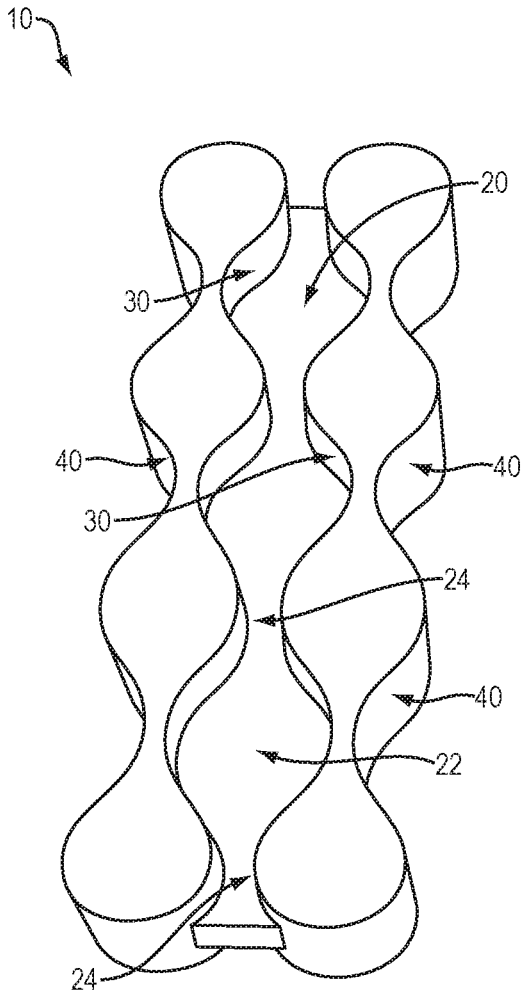
FIGS. 1A-B depict a slit-fixture pattern in accordance with an embodiment of the present invention. The slit-fixture is formed by two S-wave patterned walls in which the inner and outer walls are mirrors of each other (1A). The interior pattern results in flow gradients that are favorable towards areas of lower resistance (i.e., larger surface diameter). The local electric field strength at the outer walls where the pattern is convex is lower than when the pattern in concave (2B).
Figure 1B:
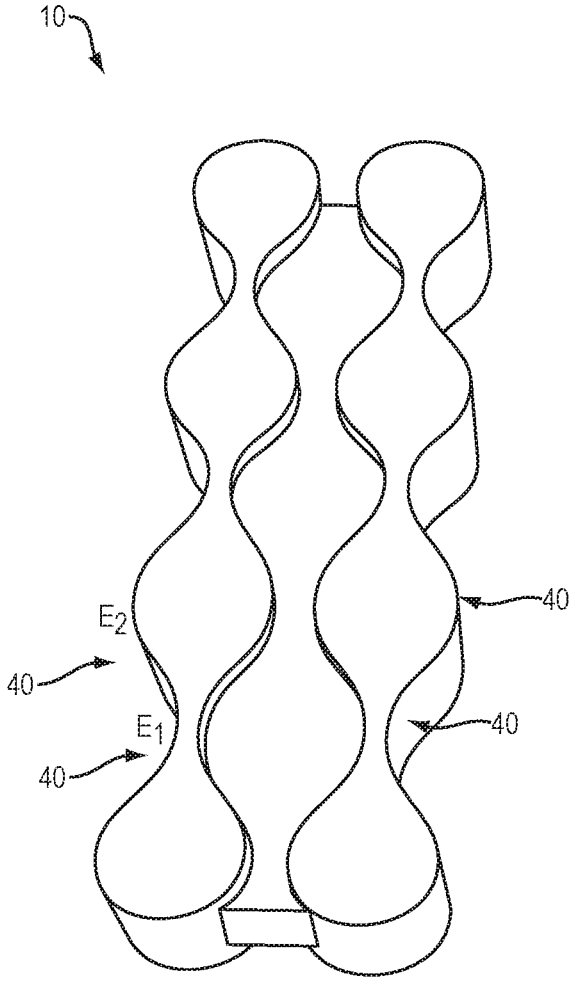

In one embodiment of the invention, slit-fixture (10) includes a slit-surface (20) defined by inner and outer walls (30, 40) that form two wave-patterns which are mirror images of each other, as illustrated in FIG. 1. As used herein, inner wall (30) refers to the portion of slit-fixture (10) that is in direct contact with the polymer fluid (not shown) from which the polymer fiber is formed, while outer wall (40) refers to the portion of slit-fixture (10) that is not in direct contact with the polymer solution. In embodiments in which multiple fibers are produced at once, the inner wall (30) of one slit-surface (20) may be the outer wall (40) of another slit-surface (20). While not intending to limit the present invention to any specific mechanism(s) of performance, this design is believed to localize jet formation by (1) creating favorable flow gradients towards slit-surface (20) where the interior pattern results in a larger opening (22) (i.e., flow is directed to the area of least resistance) and (2) creating a higher local electric field at the exterior walls where the pattern concaves inwards (24) to help constrain or control jet movement. Additionally, as illustrated in FIG. 1B, the local electric field is lower at the locations of outer wall (40) where the pattern is convex ($E_1$) than where the pattern is concave ($E_2$).

Slit-fixture (10) may be made of any suitable metal or conductive material known in the art and in other embodiments, may be coated with a thin layer of Teflon, lubricious polymer, or another non-stick material such as a hydrogel so as to minimize flow resistance. In other embodiments of the invention, the surface of the slit-fixture may be polished to be smooth or etched to be rough, or textured.

Figure 2:
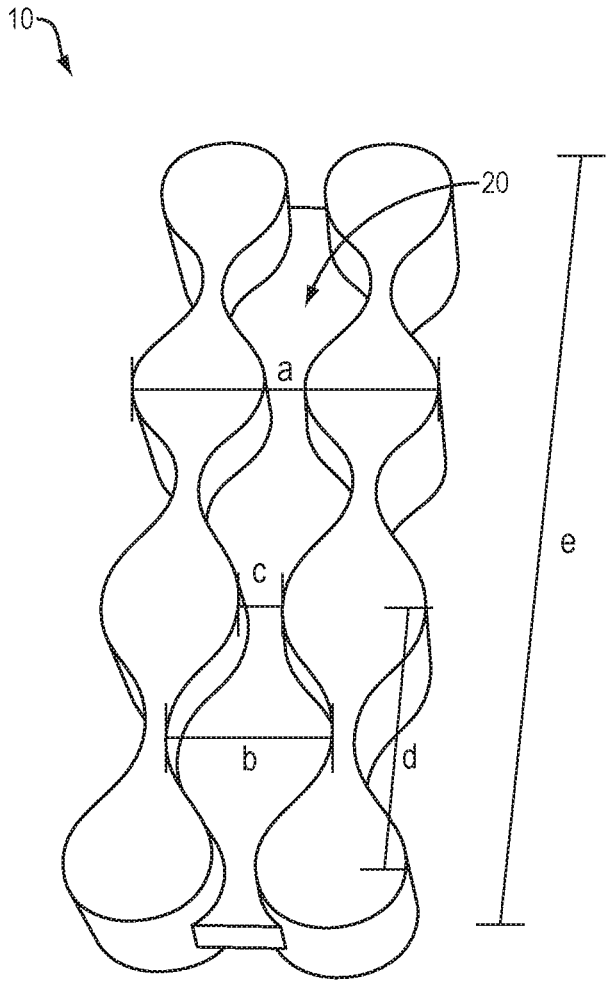
FIG. 2 illustrates the relevant dimensions of the slit-fixture of FIG. 1 that define the features of the patterned slit-surface, in accordance with an embodiment of the present invention.

The relevant dimensions for the patterns and features of slit-surface (20) are shown in FIG. 2. "A" is preferably 0.5-100 mm, and more preferably 2-14 mm; "B" is preferably 0.4-40 mm, and more preferably 2-8 mm; "C" is preferably 0.1-10 mm, and more preferably 0.5-2 mm. Dimension "D" refers to a frequency or wavelength per unit length. In one embodiment, the preferred frequency is 20-2000/m, while a more preferred frequency is 100-400/m.

Figure 3A:
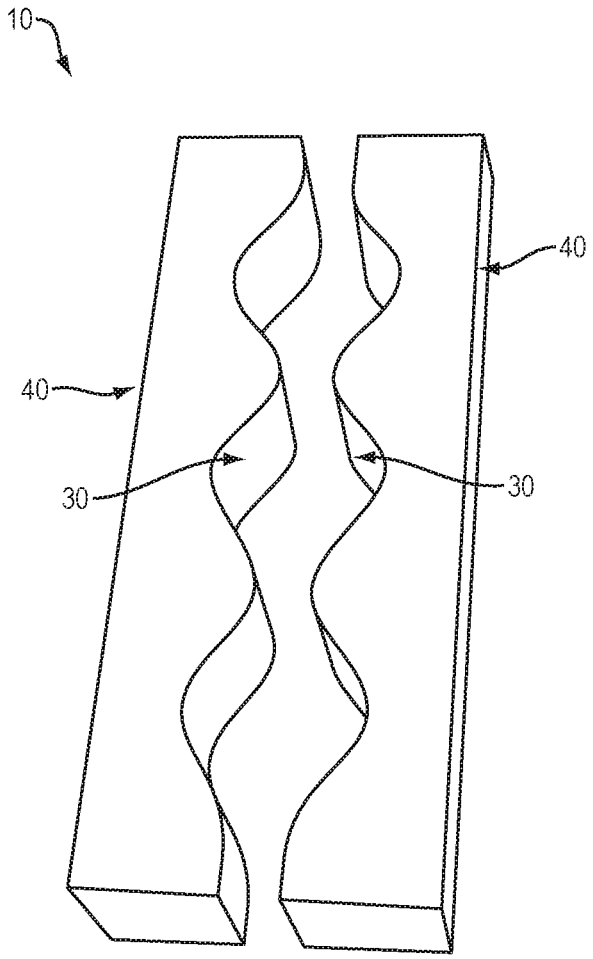
FIGS. 3A-D depict additional slit-fixture patterns in accordance with embodiments of the present invention. One such design is similar to that of FIG. 1, with the S-wave pattern only applied to the inner walls of the fixture while the outer walls are straight (3A). In a second design, the S-wave pattern is only applied to the outer walls of the fixture while the inner walls are straight (3B). In a third design, the S-wave pattern is applied to both the inner and outer walls, with the distance between the surfaces of the inner and outer walls being constant throughout the length of the fixture (3C). A fourth design is similar to that of FIG. 1, except that the inner and outer walls are aligned to have matching wavelengths and amplitudes (3D).
Figure 3B:
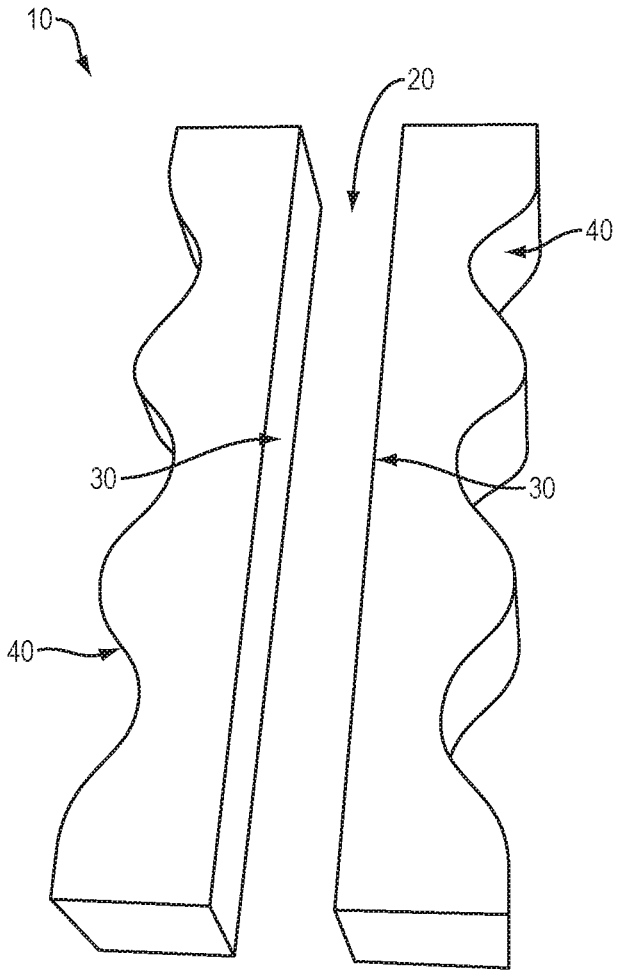
Figure 3C:
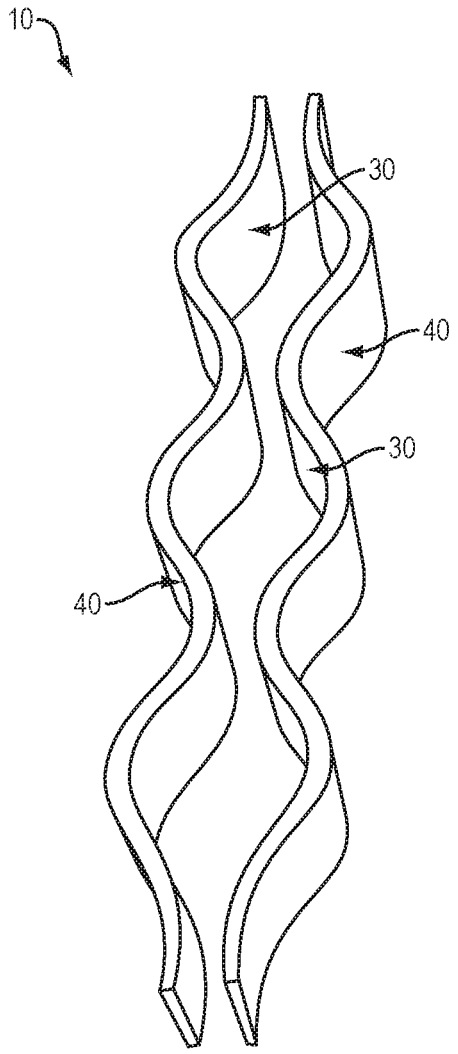
Figure 3D:
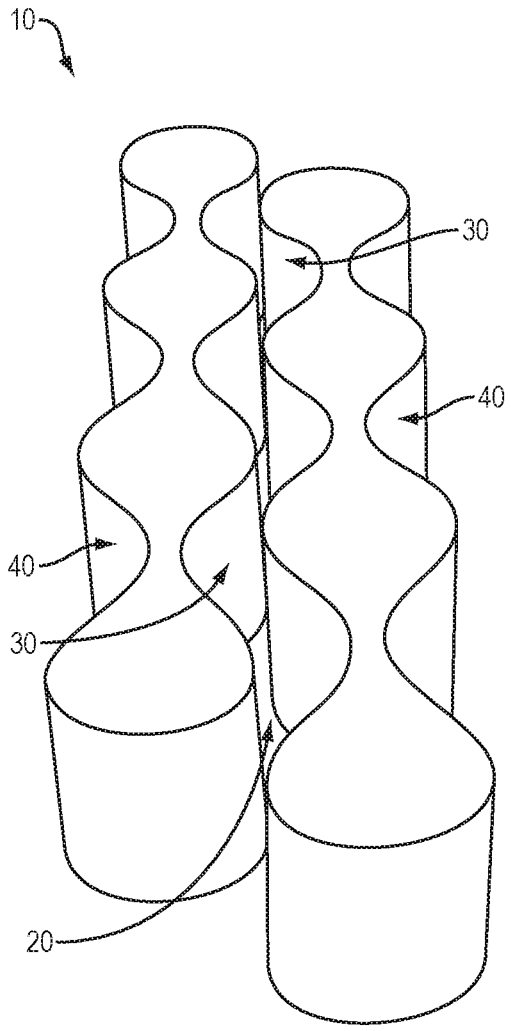

In addition to the wave-like pattern described above, three other embodiments are shown in FIG. 3. One embodiment, as shown in FIG. 3A, is similar to the design of FIG. 1A except that outer wall (40) of the slit-fixture (10) is straight rather than wavy. The design of this embodiment is advantageous in situations where a uniform electric field is required. In another embodiment, as shown in 3B, slit-surface (20) retains the wave-like pattern on outer walls (40) of slit-fixture (10) while the inner walls (30) are straight. This embodiment may be advantageous when it is desirable to have a uniform flow gradient in which the electric field controls the electrospinning jets. In another embodiment as shown in 3C, inner and outer walls (30, 40) of slit-fixture (10) have a wave-like pattern, but the distance between the surfaces of the inner and outer walls (30, 40) is constant throughout the length of slit-fixture (10). In yet another embodiment, as shown in 3D, the pattern of slit-surface (20) is defined by inner and outer walls (30, 40) that are aligned to have matching wavelengths and amplitudes.

Figure 4A:
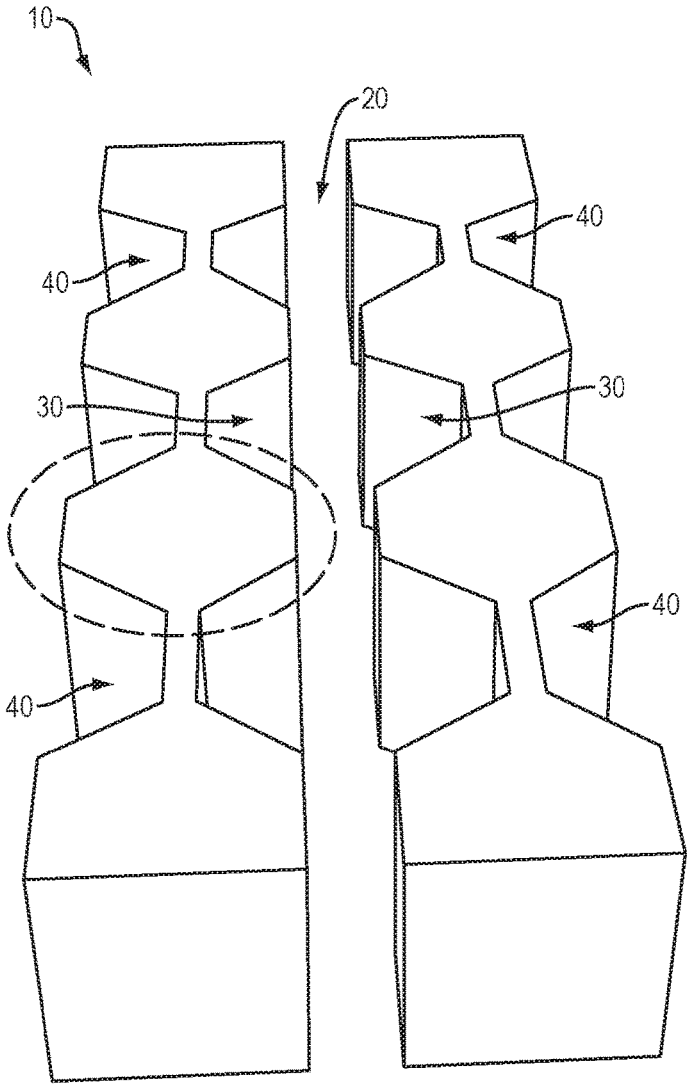
FIGS. 4A-B depict slit-fixture patterns with non-curvy (i.e., non-sinusoidal) patterns such as hexagonal (4A) and diamond (4B) shapes, in accordance with an embodiment of the present invention.
Figure 4B:
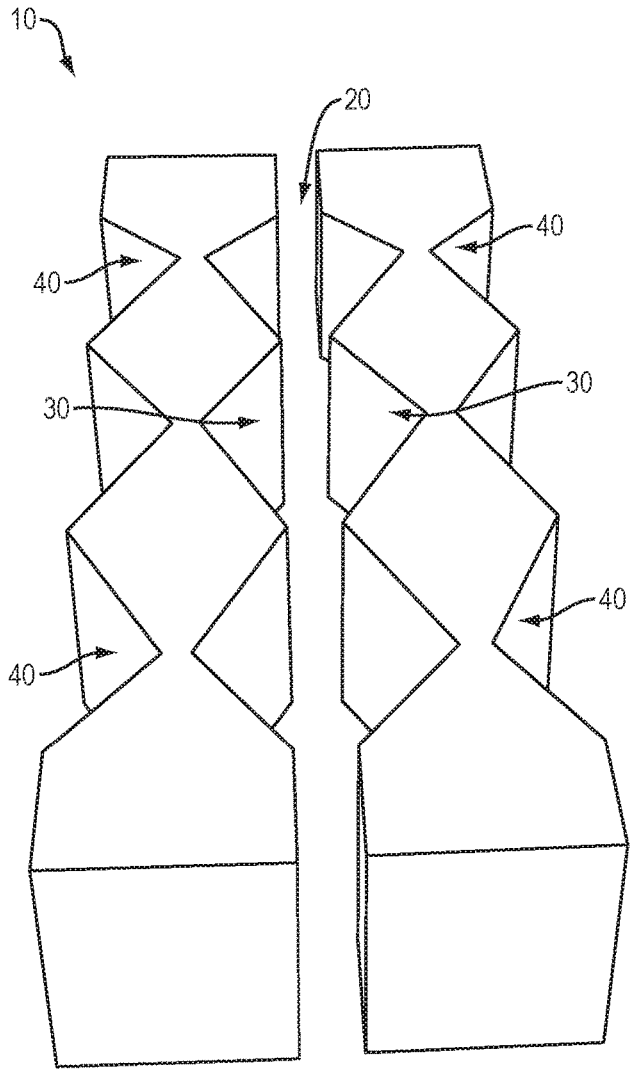

The invention described herein is not limited to any particular shape. Aside from wave-like patterns described above, any geometric shape may be used as the replicating unit. Accordingly, it will be appreciated that inner and outer walls (30, 40) of slit-fixture (10) are not limited to wave-like or sinusoidal shapes. In other embodiments of the invention, the pattern(s) of inner and/or outer walls (30, 40) include linear features (i.e., defined by straight lines that intersect at angles relative to each other). For example, in one embodiment as shown in FIG. 4A, inner and outer walls (30, 40) are patterned to form hexagonal shapes; whereas in another embodiment inner and outer walls (30, 40) are patterned to form diamond shapes, (as shown in FIG. 4B).

Figure 5:
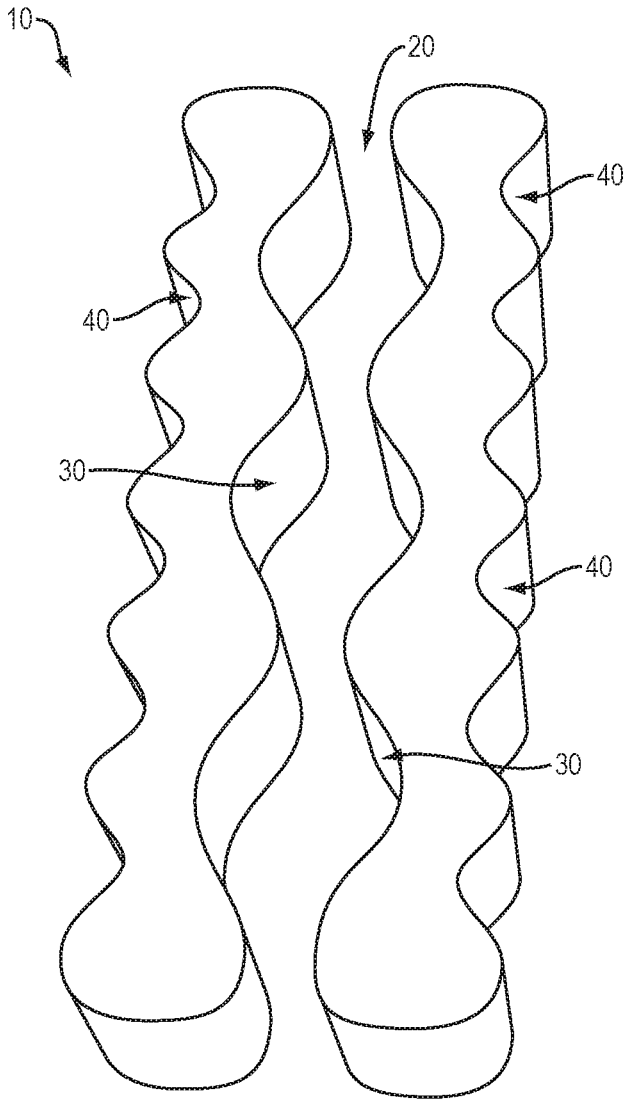
FIG. 5 depicts a slit-fixture pattern in which the S-wave pattern of the outer wall has a higher frequency than the S-wave pattern of the inner wall, in accordance with an embodiment of the present invention.

In other embodiments, the wave-patterns on both the inner and outer walls (30, 40) are different. For example, as illustrated in FIG. 5, the wavelength pattern of outer wall (40) may have a higher frequency than the wavelength pattern of inner wall (30).

Figure 6A:
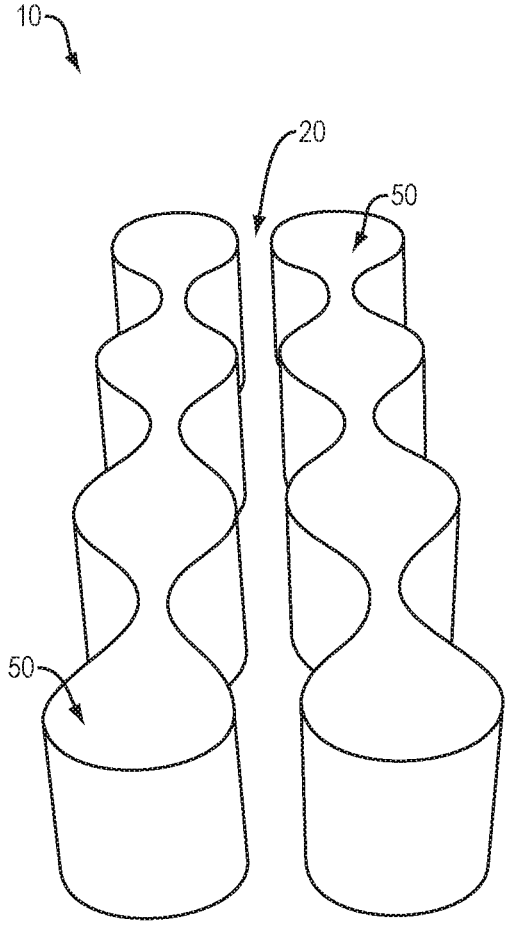
FIGS. 6A-F depict slit-fixtures with patterned top surfaces that vary in shape and depth, in accordance with an embodiment of the present invention. As compared to a flat horizontal surface (6A), in one design the S-wave pattern is applied to the top surface of the fixture (i.e., in the vertical direction) while the inner and outer walls are flat (6B). In a second design, the pattern of the top surface has an outwardly slanting apex (6C). In a third design, the pattern of the top surface has an inwardly slanting apex (6D). In a fourth design, the pattern of the top surface is convex (6E). In a fifth design, the pattern of top surface is concave (6F).
Figure 6B:
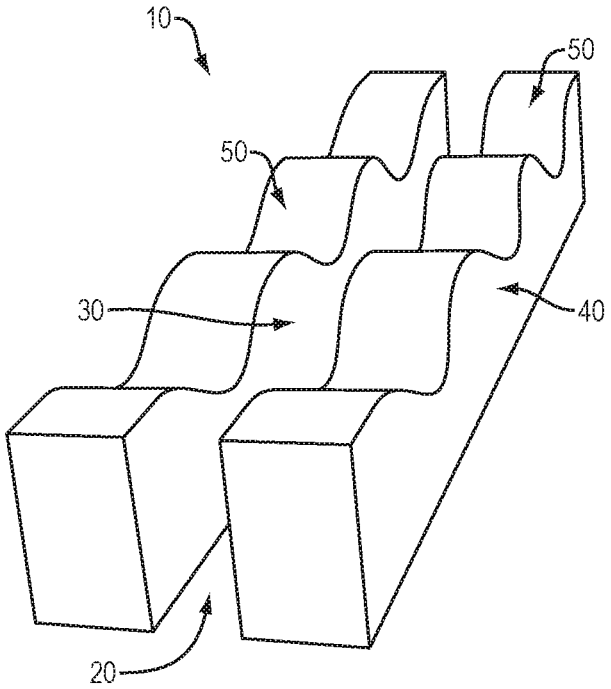
Figure 6C:
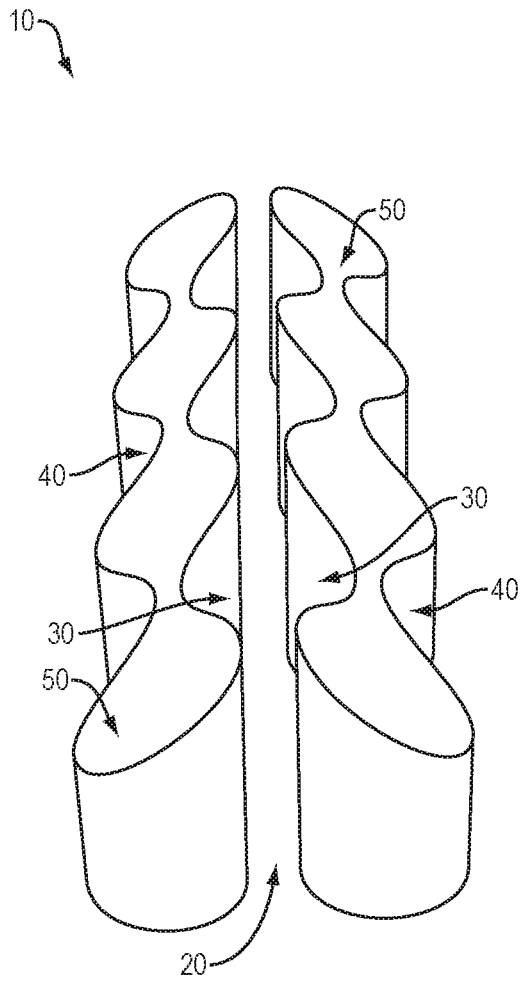
Figure 6D:
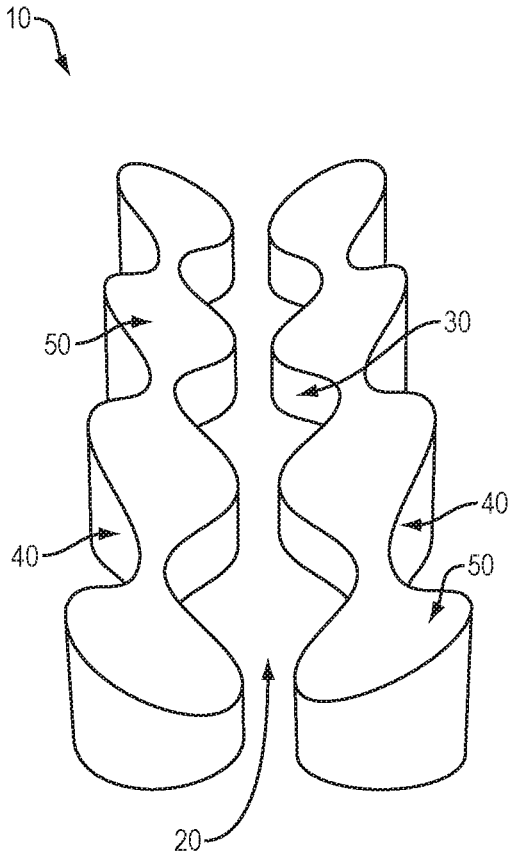
Figure 6E:
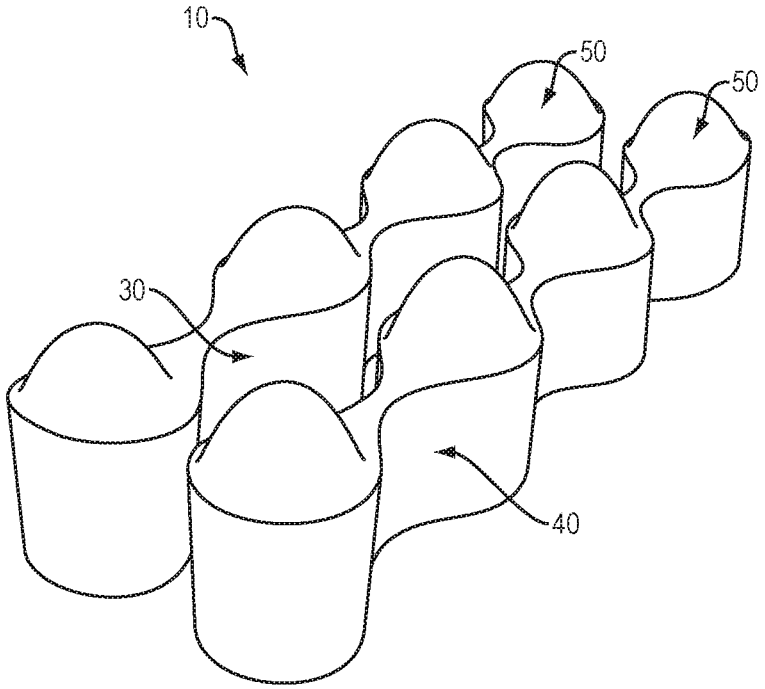
Figure 6F:
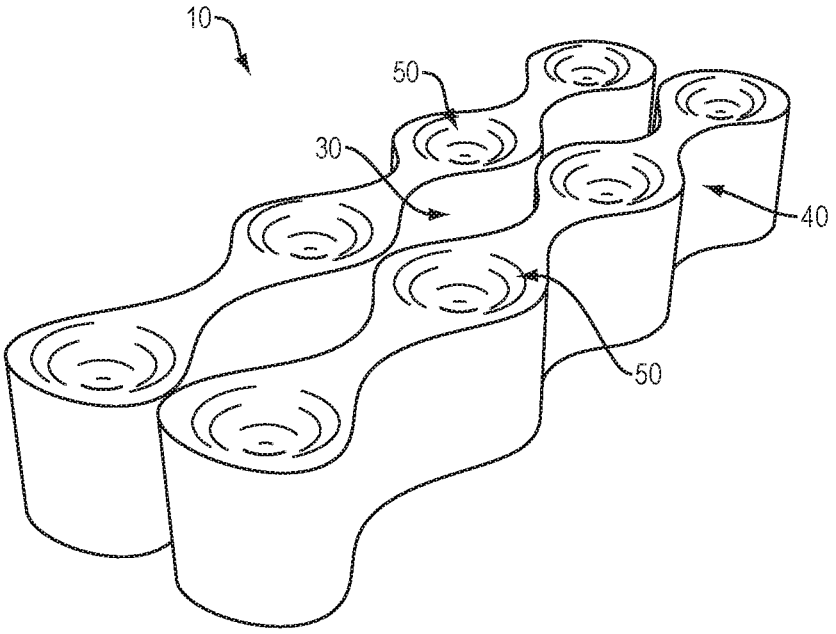

In yet other embodiments, the surface of slit-fixture (10) which faces the same direction as the flow of the polymer fiber being formed, hereinafter referred to as top surface (50) is patterned and may vary in shape, depth, and texture. For example, in one embodiment, as illustrated in FIG. 6B, inner and outer walls (30, 40) are flat, but the dimensions of top surface (50) vary in depth and shape. In other embodiments, top surface (50) is slanted at an outward or inward angle, as depicted in FIGS. 6C and 6D, respectively. Other embodiments may include combinations of different orientations of slit-surface (20) and/or slit-fixture (10) patterns disclosed herein. Furthermore, in other embodiments top surface (50) may be convex or concave, as shown in FIGS. 6E and 6F.

Figure 7:
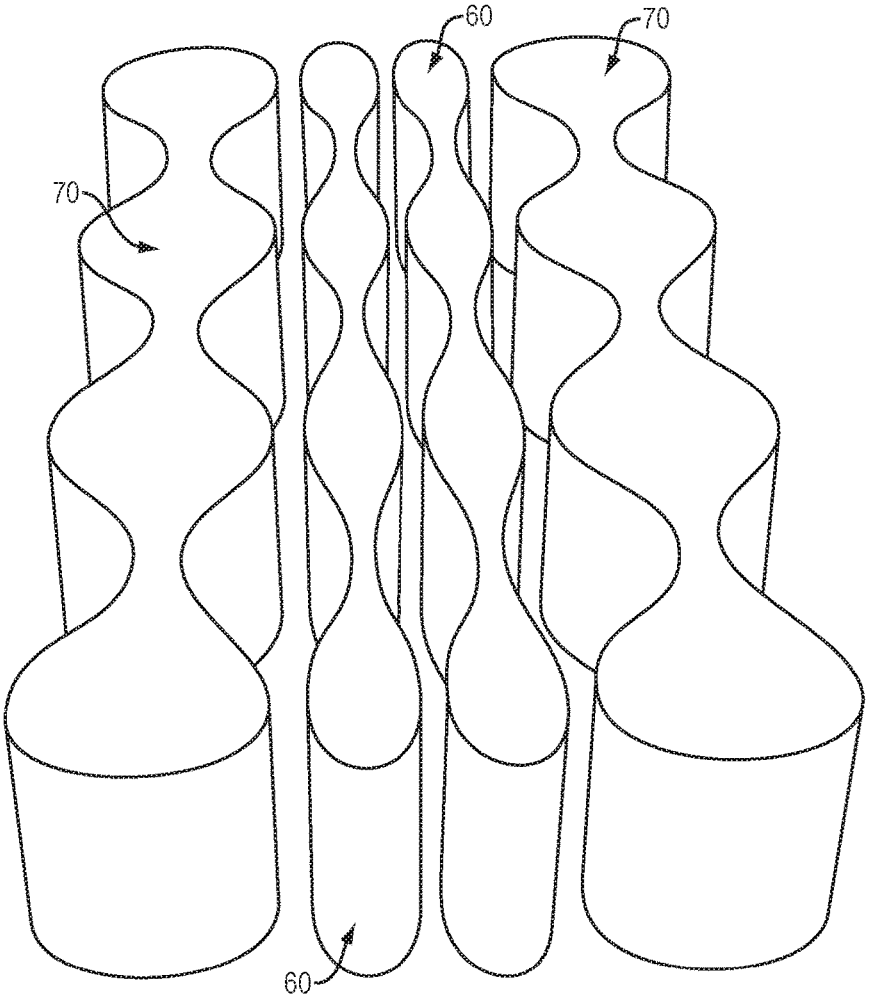
FIG. 7 depicts a slit-fixture design for use with two or more different polymers, in which a core-slit fixture is positioned within a sheath-slit fixture.

In other embodiments of the invention, the silt-fixture of the present invention is used to create fibers which are composed of two or more different polymers, with the core polymer concentrically contained within the other, sheath polymer. This can be achieved by placing one slit-fixture within the other, as shown in FIG. 7. As used herein, the slit-fixture which forms the core fiber is referred to as the "core-slit" (60), and the slit-fixture which forms the sheath fiber is referred to as the "sheath-slit" (70). Core-slit (60) may be straight or patterned into any of the designs described herein. For example in the embodiment shown in FIG. 7, both core-slit fixture (60) and sheath-slit fixture (70) have S-like patterns on their respective inner and outer walls.

Figure 8A:
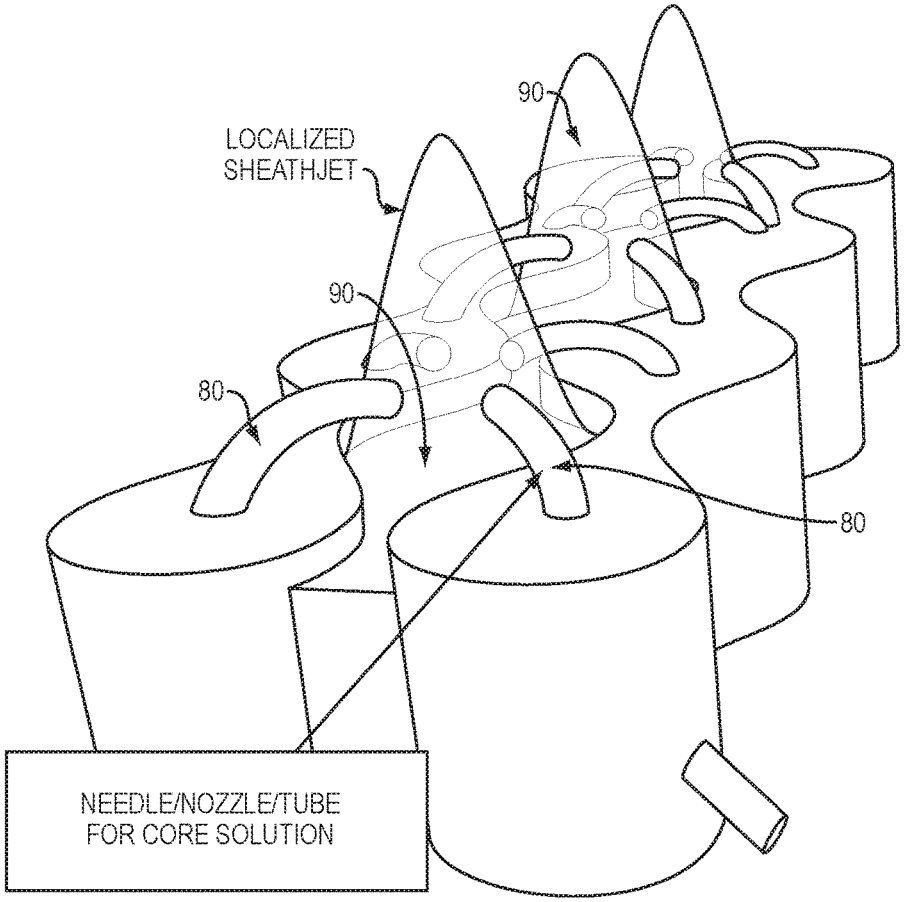
FIGS. 8A-C depict electrospinning devices for use with two or more different polymers that do not require the presence of a core-slit, in accordance with an embodiment of the present invention. In one design, the precise localization of electrospinning jets allows feed tubes/needles to deliver core polymer solution directly into the emitted sheath jet (8A). In another design, feed lines/tubes protrude into the sheath jet from underneath to deliver core polymer solution directly into the emitted sheath jet (8B). In another design, a patterned array of slit-surfaces individually feed the core polymer solution directly into each emitted sheath jet (8C).
Figure 8B:
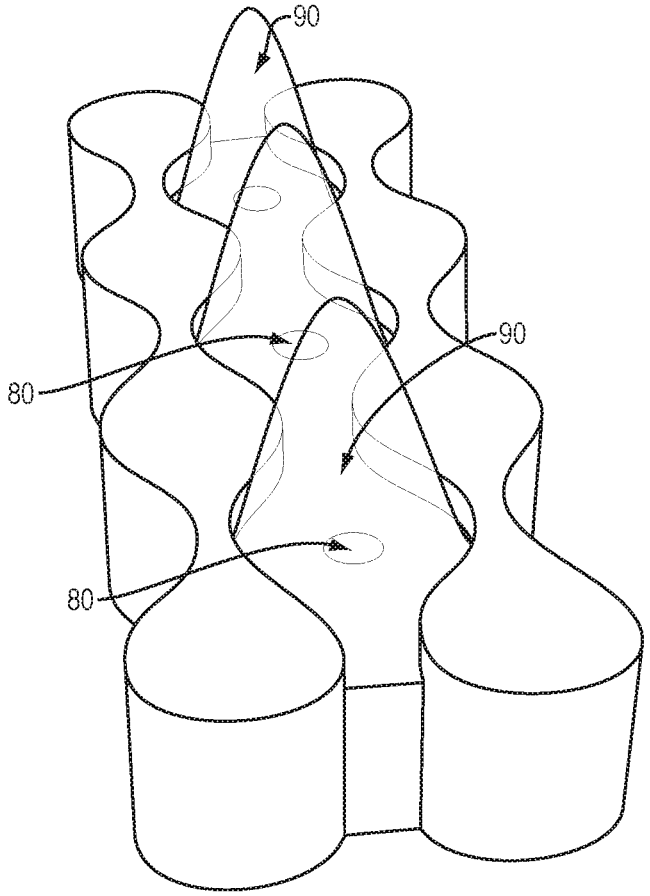
Figure 8C:
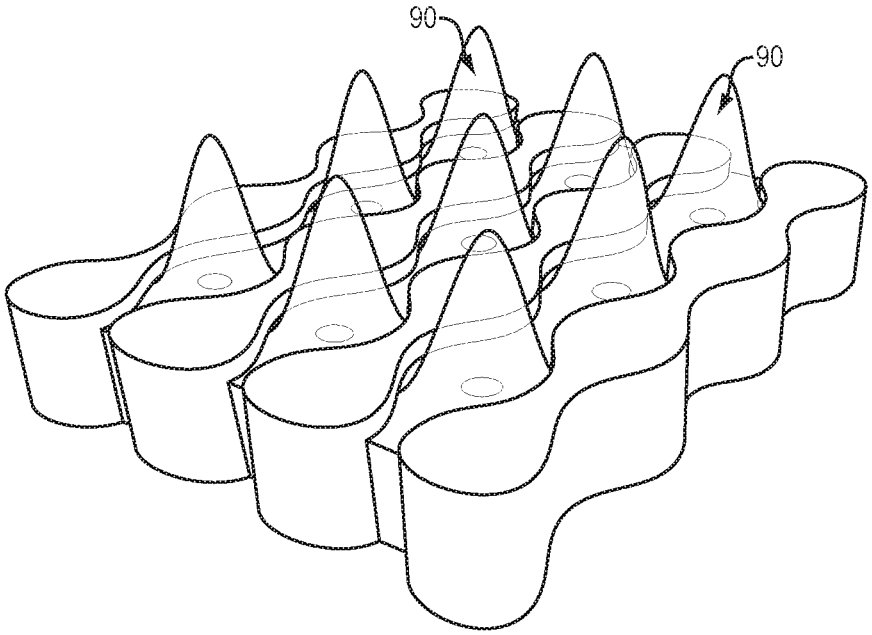

In other embodiments, a core-slit is not needed to create polymer fibers composed of concentric, different polymers. For example, in some embodiments feed tubes or needles (80) deliver core polymer solution to the inside of an emerged electrospinning jet. This is possible due to the precise localization of electrospinning sheath jets (90), as shown in FIG. 8A. Any number of feed tubes (80) can be inserted into sheath jet (90) to deliver one or more streams of polymer solution into the jet such that the resulting electrospun fibers incorporate multiple different polymer compositions. For instance, the feed tube or tubes (80) can, in some cases, deliver one or more core polymer solutions to the center of the sheath jet (90), resulting in the formation of concentric-core-sheath fibers. Alternatively, the feed tube(s) (80) are offset relative to the center to form non-concentric core-sheath fibers, or may even apply the polymer solution near an exterior of the Taylor cone, such that the exterior of the resulting fibers incorporate two distinct polymer compositions. Tubes (80) can either deliver the same or different core solutions. In another embodiment, the core solution can be fed into the sheath solutions via discrete needles (80) that protrude into the sheath jets (90) from underneath, as depicted in FIG. 8B. Moreover, due to the precise localization of electrospinning jets (90), in some embodiments an array of patterned slit-surfaces can be created and each one individually fed with core solution, as shown in FIG. 8C.

Figure 9:
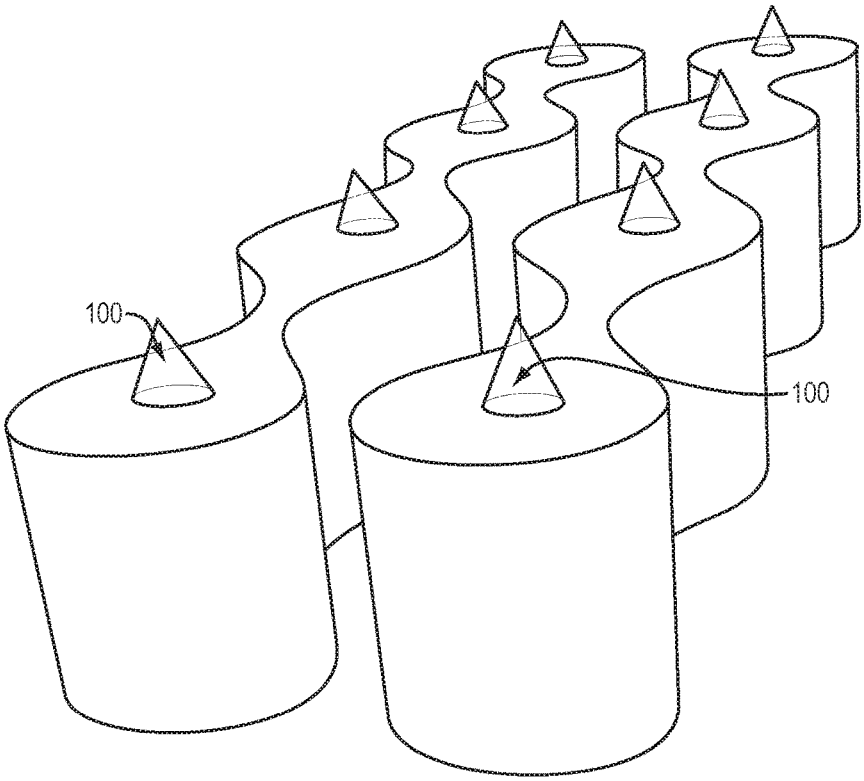
FIG. 9 depicts a slit-fixture patterned with protrusions or indentations that serve as auxiliary electrodes, in accordance with an embodiment of the present invention.

In yet another embodiment, the slit-fixture is patterned with protrusions (100) as depicted in FIG. 9, or indentations (not shown). These protrusions and/or indentations serve as auxiliary electrodes that further impact electric fields. Additionally, auxiliary electrodes that are not designed as part of the fixture itself can also be incorporated to further influence the emergence and localization of electrospinning jets. As used herein, auxiliary electrodes include any material that is electrically conductive and that can be shaped, including for example, wires.

Figure 10:
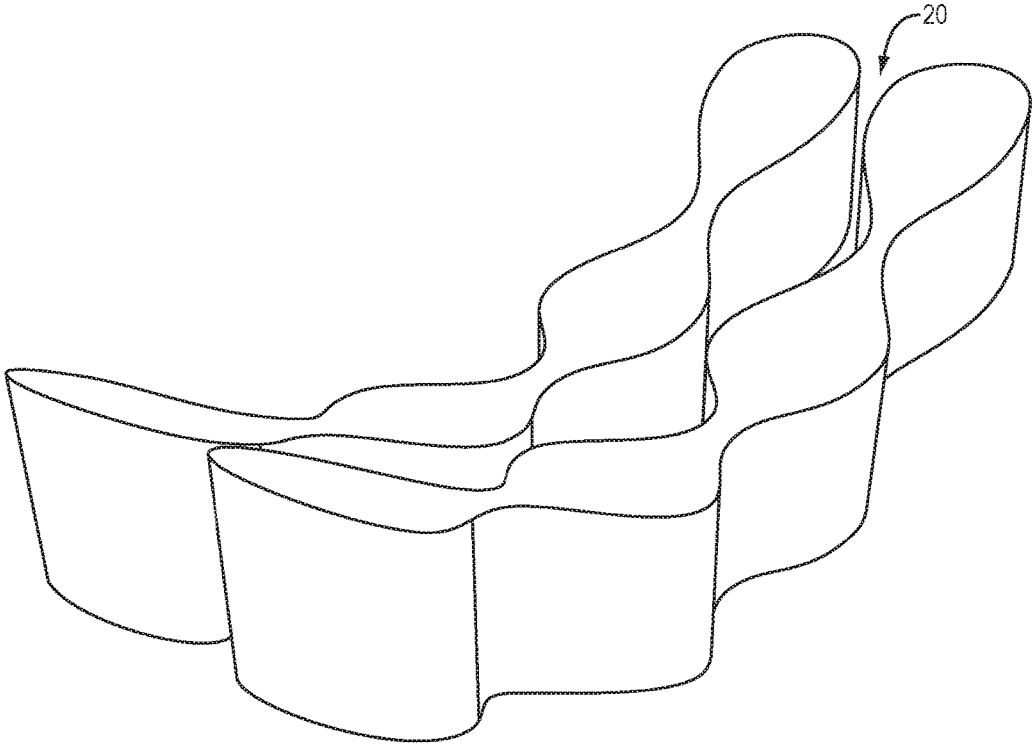
FIG. 10 depicts a slit-fixture with a curved top surface, in accordance with an embodiment of the present invention.

In other embodiments of the invention, the patterned slit-surface (20) does not have to be linear, but can be a closed loop, such as a circle, square, triangle, etc. Similarly, slit-surfaces (20) can be branched, spiraled, or curved, as illustrated in FIG. 10.

In other embodiments of the invention, the slit-surfaces (20) can slide or vibrate relative to each other during the electrospinning process. These mechanical movements may further assist in preventing solvent evaporation that contributes to meniscus formation. Alternatively, slit-fixtures (10) can be heated or cooled to control the temperature of the polymer solutions flowing through slit-surfaces (20).

Figure 11:
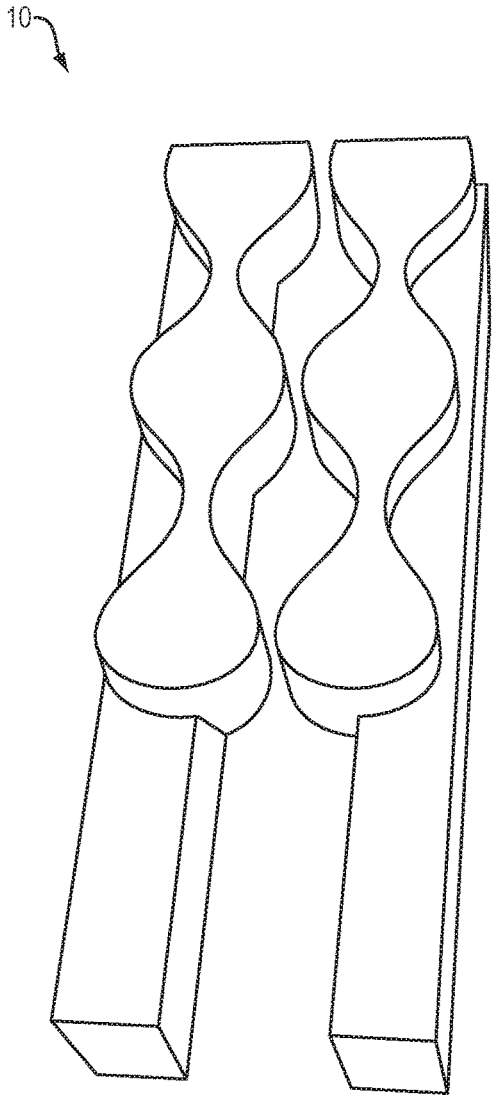
FIG. 11 depicts the attachment of a secondary element to the slit-surface fixture to create different sheath jet patterns.

In another embodiment, secondary element(s) having a variety of different shapes may be attached to slit-fixture (10), thus facilitating the creation of different patterns by simply removing and replacing the secondary element (FIG. 11).

Figure 12A:
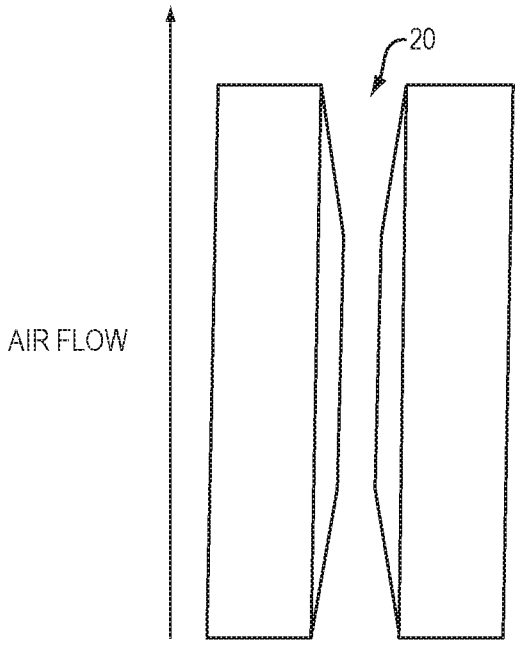
FIGS. 12A-C depict designs for diverting air flow away from the slit-surface, in accordance with an embodiment of the present invention. As compared to the standard air-flow around the slit-surface (12A), in one design air flow is mitigated by adding elements (i.e., wings) that divert air flow away from the slit-surface (12B). In another design, air flow is mitigated by increasing the thickness of the apex of the slit-surface (12C).
Figure 12B:
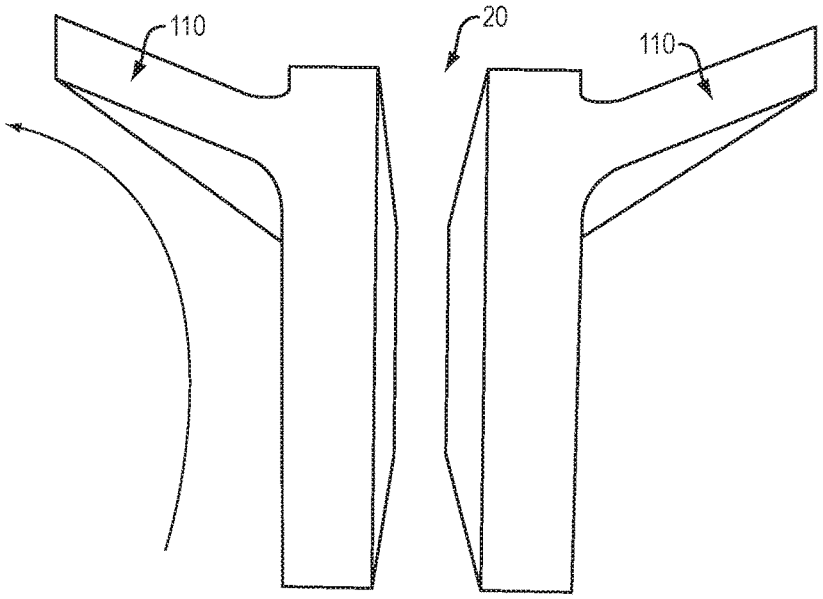
Figure 12C:
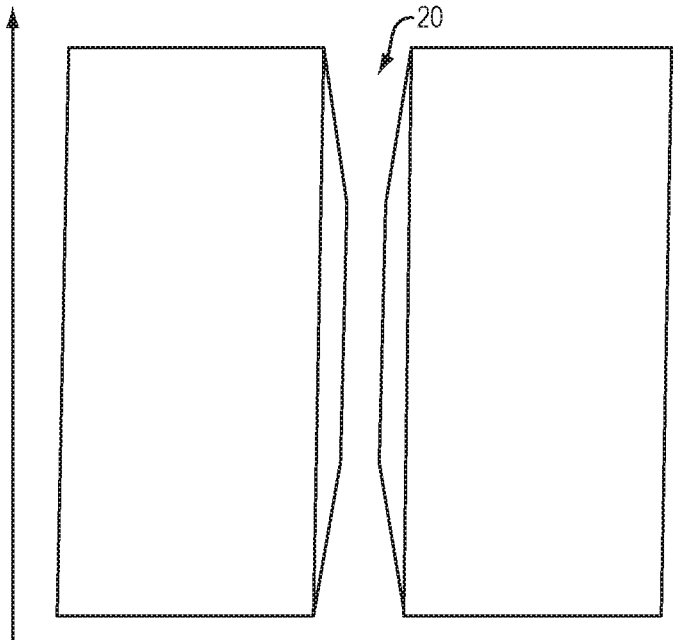

In other embodiments, design features may be included that mitigate the flow of air to the aperture of slit-surface (20) to minimize solvent evaporation. As shown in FIG. 12B, this can be achieved by adding wing-like elements (110) that divert air flow away from slit-surface (20). Alternatively, the wall thickness of the apex that creates slit-surface (20) can be increased so that air flow is further removed from the slit-surface, as shown in FIG. 12C.

Figure 13:
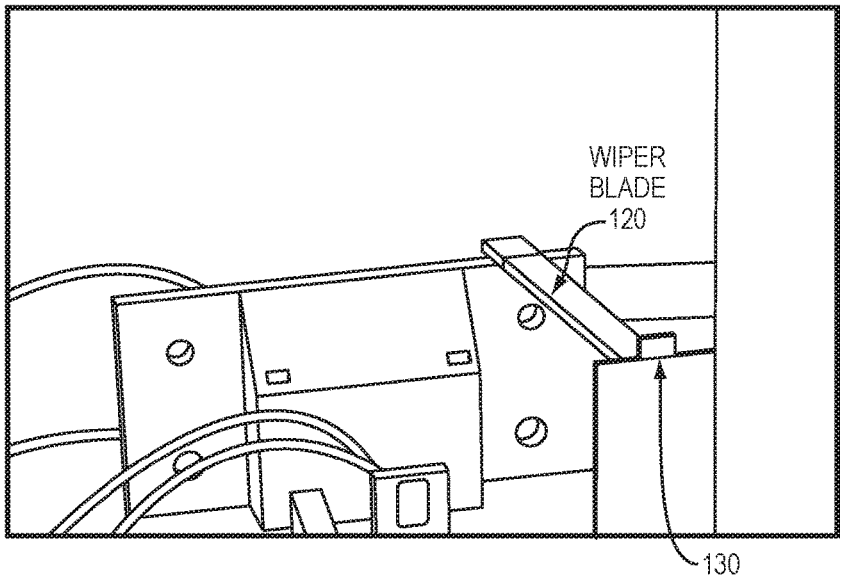
FIG. 13 depicts a fixture (i.e., wiper) for removal of excess polymer solution that accumulates at the slit-surface due to meniscus growth and/or polymer solidification, in accordance with an embodiment of the present invention.

In certain systems, electrospinning from a slit-surface results in large meniscus growth and/or the accretion of solid materials near sites of Taylor cone initiation. These in turn may compromise the morphology of the affected Taylor cones, reducing the efficiency of electrospinning. For continuous operation of such electrospinning processes, an automated fixture is used to wipe or otherwise remove the excess solution that accumulates at the slit due to the meniscus growth and/or solidification. An example of such a system is shown in FIG. 13, in which a wiper blade or similar element (120) is attached to a linear actuator (130) that can be programmed to slide or otherwise move the wiper blade. Alternative approaches to address this issue include using an air knife or high-velocity gas/fluid, incorporating solvent or polymer into the wiper head to facilitate cleaning and/or resetting the meniscus, using textured or patterned wiper units, multiple wiper units, string or wire as a wiping instrument, or an elastomeric squeegee.

Figure 14A:
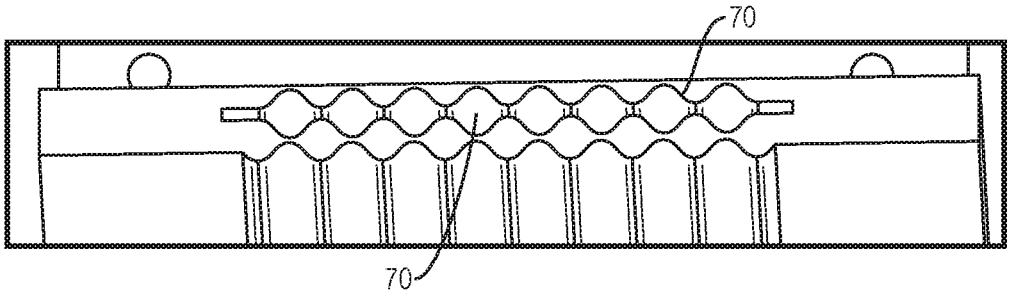
FIGS. 14A-B depict a side-by-side comparison of a slit-fixture with wavy patterns on both the inner and outer walls of the slit-surface (14A), to a wavy patterned slit-fixture assembled with a straight core-slit (14B), in accordance with an embodiment of the present invention.
Figure 14B:
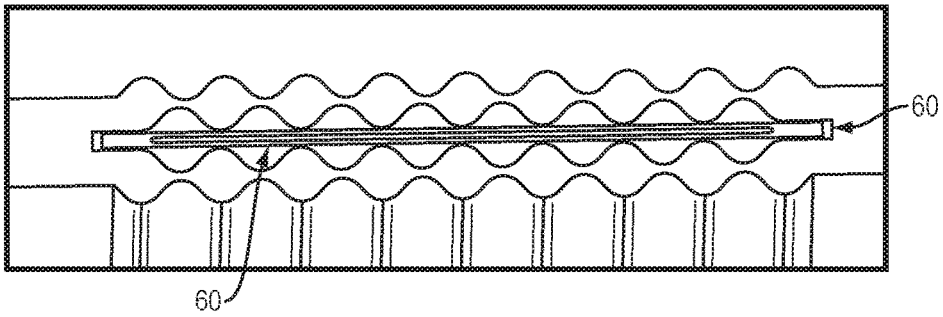

FIGS. 14A and 14B depict a non-limiting example of an embodiment of the present invention in which a slit-fixture with wavy patterns on the inner and outer walls of sheath-slit (70) were compared side-by-side with slit-fixture having a straight core-slit (60). Both devices were tested using sheath and core solutions of 5.5 wt % 8515 PDLGA in hexafluoroisopropanol and 12 wt % polycaprolactone in 6:1 (by vol) chloroform:methanol containing 30% dexamethasone with respect to the polymer, respectively. Flow rates were set to 200 and 20 ml/h for the sheath and core solutions, respectively. A voltage of 90 kV was applied.

Figure 15A:
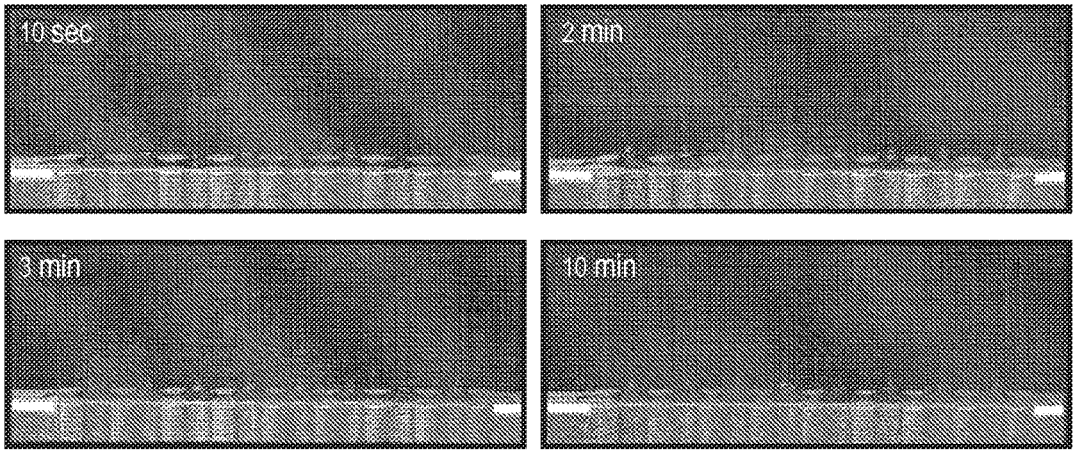
FIGS. 15A-B compare the lateral movement and solution meniscus growth resulting from electrospinning of sheath and core solutions using the slit-fixture designs of FIGS. 14A and 14B.
Figure 15B:
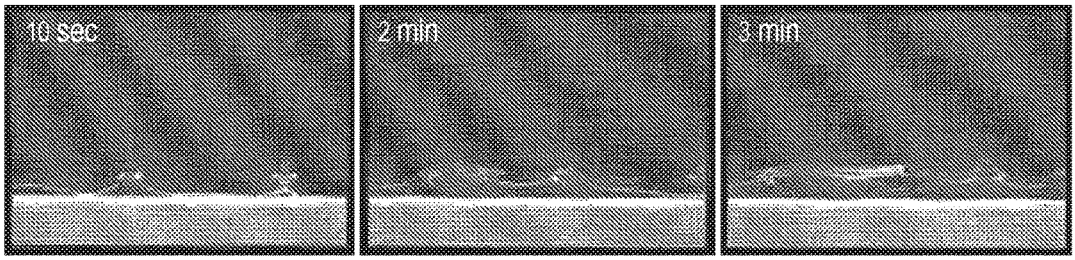

As compared to slit-surface electrospinning where the sheath-slit is not patterned, two significant effects were observed. First, there was no lateral movement of the electrospinning jets when the patterned slit was used; and second, there was no solution meniscus growth. The ability to eliminate both lateral movement and meniscus growth allows stable and continuous electrospinning to occur for greater than 10 minutes, which is equivalent to at least a five-fold increase relative to current baseline run time achieved on a straight-slit system. As shown in FIG. 15, the number of electrospinning jets remained constant at 8 (coinciding with the wave number) throughout 10 minutes of electrospinning and exhibited no meniscus growth. In contrast, a straight core-slit utilized under the same conditions resulted in a less stable electrospinning process that became compromised by 2 or 3 minutes.

While several embodiments of the present invention have been described and illustrated herein, those of ordinary skill in the art will readily envision a variety of other means and/or structures for performing the functions and/or obtaining the results and/or advantages described herein. Each of such variations and/or modifications is deemed to be within the scope of the present invention. More generally, those skilled in the art will readily appreciate that all parameters, dimensions, materials and configurations described herein are meant to be exemplary and that the actual parameters, dimensions, materials and/or configurations will depend upon the specific application or applications for which the teachings of the present invention is/are used. Those skilled in the art will recognize, or be able to ascertain using no more than routine experimentation, many equivalents to the specific embodiments of the invention described herein. It is, therefore, to be understood that the foregoing embodiments are presented by way of example only and that, within the scope of the appended claims and equivalents thereto, the invention may be practiced otherwise than as specifically described and claimed. The present invention is directed to each individual feature, system, article, material, kit and/or method described herein. In addition, any combination of two or more such features, systems, articles, materials, kits and or methods, if such features, systems, articles, materials, kits and/or methods are not mutually inconsistent, is included within the scope of the invention.

The indefinite articles "a" and "an," as used herein, unless clearly indicated to the contrary, should be understood to mean "at least one."

The phrase "and/or," as used herein should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified unless clearly indicated to the contrary. Thus, as a non-limiting example, a reference to "A and/or B," when used in conjunction with open-ended language such as "comprising" can refer, in one embodiment, to A without B (optionally including elements other than B); in another embodiment, to B without A (optionally including elements other than A); in yet another embodiment, to both A and B (optionally including other elements); etc.

As used herein, "or" should be understood to have the same meaning as "and/or" as defined above. For example, when separating items in a list, "or" or "and/or" shall be interpreted as being inclusive, i.e., the inclusion of at least one, but also including more than one, or a number or list of elements, and optionally, additional unlisted items. Only terms clearly indicated to the contrary, such as "only one of," or "exactly one of," or when used in the claims, "consisting of," will refer to the inclusion of exactly one element of a number or list of elements. In general, the term "or" as usped herein shall only be interpreted as indicating exclusive alternatives (i.e., "one or the other but not both") when preceded by terms of exclusivity, such as "either," "one of," "only one of," or "exactly one of." "Consisting essentially of," when used in the claims, shall have its ordinary meaning as used in the field.

As used herein, the phase "at least one," in reference to a list or one or more elements, should be understood to mean at least one element selected from any one or more of the elements in the list of elements, but not necessarily indicating at least one of each and every element specifically listed within the list of elements and not excluding any combination of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

As used herein, the term "consists essentially of" means excluding other materials that contribute to function, unless otherwise defined herein. Nonetheless, such other materials may be present, collectively or individually, in trace amounts.

Reference throughout this specification to "one example," "an example," "one embodiment," or "an embodiment," means that a particular feature, structure, or characteristic described in connection with the example is included in at least one example of the present technology. Thus, occurrence of the phrases "in one example," "in an example," "one embodiment," or "an embodiment" in various places throughout the specification are not necessarily all referring to the same example. Furthermore, the particular features, structures, routines, steps or characteristics may be combined in any suitable manner in one or more examples of the technology.

What is claimed is:

1. An electrospinning apparatus, comprising: a vessel having an elongate aperture disposed between opposing elements, each element having an inner wall with a first pattern and an outer wall with a second pattern, a fluid reservoir in fluid communication with said vessel, a voltage source configured to apply a voltage to said vessel, and a collector positioned at a distance from the elongate aperture, wherein the first pattern defines a region of enhanced fluid flow, and the second pattern defines a region of enhanced electric potential.

2. The apparatus of claim 1, wherein the vessel is formed from an electrically conductive material.

3. The apparatus of claim 1, wherein the collector includes at least one electrically grounded point thereon.

4. The apparatus of claim 1, wherein the first and second patterns mirror each other.

5. The apparatus of claim 1, wherein a distance between a surface of the inner and outer walls is constant along their length.

6. The apparatus of claim 1, wherein the first pattern includes an S-wave pattern.

7. The apparatus of claim 1, wherein the first and second patterns mirror each other.

8. A method of electrospinning, comprising:

providing:

a vessel having an elongate aperture disposed between opposing elements, each element having an inner wall with a first pattern and an outer wall with a second pattern, wherein the first pattern provides a region of enhanced fluid flow through the aperture, and wherein the second pattern provides a region of enhanced electric potential across the aperture, a fluid reservoir containing a polymer solution in fluid communication with said vessel, a collector positioned at a distance from the elongate aperture, and a voltage source configured to apply an electrical potential between the aperture and the collector, wherein the first pattern defines the shape of the elongate aperture and the second pattern defines the electric potential of the elongate aperture;

flowing the polymer solution through the aperture;

applying an electrical potential between the aperture and the collector to form at least one electrospinning jet, thereby forming an electrospun fiber; and collecting the electrospun fiber on the collector.

9. The method of claim 8, wherein the vessel is formed from an electrically conductive material.

10. An electrospinning apparatus, comprising: a vessel having an elongate aperture disposed between opposing elements, each element having an inner wall with a first pattern and an outer wall with a second pattern, a fluid reservoir in fluid communication with said vessel, a voltage source configured to apply a voltage to said vessel, and a collector positioned at a distance from the elongate aperture, wherein the first pattern defines a region of uniform fluid flow, and the second pattern defines a region of enhanced electric potential.

11. The apparatus of claim 10, wherein the vessel is formed from an electrically conductive material.

12. The apparatus of claim 10, wherein the collector includes at least one electrically grounded point thereon.

13. The apparatus of claim 10, wherein a distance between a surface of the inner and outer walls is constant along their length.

14. The apparatus of claim 10, wherein the second pattern includes an S-wave pattern and the first pattern is substantially straight.

15. A method of electrospinning, comprising:

providing:

a vessel having an elongate aperture disposed between opposing elements, each element having an inner wall with a first pattern and an outer wall with a second pattern, wherein the first pattern provides a region of uniform fluid flow through the aperture, and wherein the second pattern provides a region of enhanced electric potential across the aperture, a fluid reservoir containing a polymer solution in fluid communication with said vessel, a collector positioned at a distance from the elongate aperture, and a voltage source configured to apply an electrical potential between the aperture and the collector, wherein the first pattern defines the shape of the elongate aperture and the second pattern defines the electric potential of the elongate aperture;

flowing the polymer solution through the aperture;

applying an electrical potential between the aperture and the collector to form at least one electrospinning jet, thereby forming an electrospun fiber; and collecting the electrospun fiber on the collector.

16. The method of claim 15, wherein the vessel is formed from an electrically conductive material.

* * * * *